US008832888B2

(12) United States Patent
Chunglo

(10) Patent No.: US 8,832,888 B2
(45) Date of Patent: Sep. 16, 2014

(54) MATTRESS AND SIDE RAIL ASSEMBLIES HAVING HIGH AIRFLOW

(75) Inventor: Christopher F. Chunglo, Marietta, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 401 days.

(21) Appl. No.: 13/354,015

(22) Filed: Jan. 19, 2012

(65) Prior Publication Data

US 2013/0025065 A1 Jan. 31, 2013

Related U.S. Application Data

(60) Provisional application No. 61/513,390, filed on Jul. 29, 2011, provisional application No. 61/513,091, filed on Jul. 29, 2011.

(51) Int. Cl.
*A47C 27/15* (2006.01)

(52) U.S. Cl.
USPC ..... 5/724; 5/740

(58) Field of Classification Search
USPC ..... 5/724, 652.2, 652.1, 638, 691, 740
See application file for complete search history.

(56) References Cited

U.S. PATENT DOCUMENTS 4,233,700 A * 11/1980 Spann ..... 5/632
6,601,253 B1 8/2003 Tarquinio

* cited by examiner

*Primary Examiner* — Fredrick Conley
(74) *Attorney, Agent, or Firm* — Cantor Colburn LLP

(57) ABSTRACT

A mattress assembly includes an inner core comprising a base core layer comprising planar top and bottom surfaces, and at least one comfort layer comprising planar top and bottom surfaces disposed on the top surface of the base core layer; a side rail assembly disposed about a perimeter of the inner core; and a plurality of air channels extending from a central region of the inner core to the side rail assembly configured to permit the flow of fluid from and to the inner core.

28 Claims, 6 Drawing Sheets

MATTRESS AND SIDE RAIL ASSEMBLIES HAVING HIGH AIRFLOW

CROSS-REFERENCE TO RELATED APPLICATIONS

This application claims the benefit of U.S. Provisional Application Ser. No. 61/513,090 filed Jul. 29, 2011 and U.S. Provisional Application Ser. No. 61/513,091 filed Jul. 29, 2011, which are incorporated herein by reference in their entirety.

BACKGROUND

The present disclosure generally relates to foam mattress assemblies; specifically side rail assemblies of the mattress that exhibit increased airflow.

One of the ongoing problems associated with mattress assemblies is user comfort. To address user comfort, mattresses are often fabricated with multiple layers having varying properties such as density and hardness, among others, to suit the needs of the intended user. One particular area of concern to user comfort is the level of heat buildup in the mattress and experienced by the user after a period of time. Additionally, some mattresses can retain a high level of moisture, further causing discomfort to the user and potentially leading to foul odors. The problems can be experienced, to some extent, in pocketed coil and innerspring assembly mattresses, as well as foam mattresses. For example, foam mattresses such as those formed of polyurethane foam, latex foam, and the like, are generally known in the art. Manufacturers have employed so called memory foam, also commonly referred to as viscoelastic foams, which are generally a combination of polyurethane and one or more additives that increase foam density and viscosity, thereby increasing its viscoelasticity. These foams are often open cell foam structures having both closed and open cells but in some instances may be reticulated foam structures. The term "reticulated" generally refers to a cellular foam structure in which the substantially all of the membrane windows are removed leaving a skeletal structure. In contrast, open cell structures include both open cell (interconnected cells) and closed cells.

Unfortunately, the high density of foams used in current mattress assemblies, particularly those employing memory foam layers, generally prevents proper ventilation. As a result, the foam material can exhibit an uncomfortable level of heat to the user after a period of time. Reticulated memory foams, i.e., foams in which the cellular walls are substantially removed, are known to provide greater airflow. However, because substantially all of the cellular walls have been removed leaving behind a skeletal structure, these foams are inherently weak, provide less load-bearing capabilities relative to other non-reticulated viscoelastic foams, and are subject to fatigue at a rate faster than partially or completely closed cell foam structures. Moreover, reticulated viscoelastic foams require special processing to remove the cellular walls to form the skeletal structure making these foams relatively expensive.

Moreover, much like the mattresses described above, the current side rail assemblies, used in the mattress assemblies for edge support, also tend to act as an air dam blocking the flow of air out of the mattress. This can further reduce the ventilation of the mattress assembly and increase the amount of heat and/or moisture retained in the mattress. These side rail assemblies can redirect the flow of air (and heat and moisture) back through the top sleeping surface, thereby adding to the discomfort experienced by the user.

Accordingly, it would be desirable to provide a mattress assembly, especially a side rail assembly with an improved airflow to aid in the dissipation of user heat.

BRIEF SUMMARY

Disclosed herein are rail systems and mattress assemblies exhibiting increased airflow. In one embodiment, a mattress assembly includes an inner core comprising a base core layer comprising planar top and bottom surfaces, and at least one comfort layer comprising planar top and bottom surfaces disposed on the top surface of the base core layer; a side rail assembly disposed about a perimeter of the inner core; and a plurality of air channels extending from a central region of the inner core to the side rail assembly configured to permit the flow of fluid from and to the inner core.

In another embodiment, a side rail assembly for supporting an edge of a mattress includes a layer of foam comprising at least one channel and/or a plurality of orifices, wherein the layer is configured to be disposed about a perimeter of an inner core of the mattress, wherein the at least one channel extends through a length of the layer and the plurality of orifices extend through a width of the layer, and wherein the at least one channel and/or the plurality of orifices are configured to permit the flow of fluid from and to the inner core through the layer.

In still another embodiment, a mattress assembly includes an inner core comprising a base core layer comprising planar top and bottom surfaces, and at least one additional layer comprising planar top and bottom surfaces disposed on the top surface of the base core layer; a side rail assembly disposed about a perimeter of the inner core, wherein the side rail assembly comprises a layer of a foam comprising at least one channel and/or a plurality of orifices configured to permit the flow of fluid from and to the inner core through the layer; and a plurality of inner core air channels extending from a central region of the inner core to the at least one channel and/or plurality of orifices of the side rail assembly, wherein the plurality of inner core air channels are configured to permit the flow of fluid from and to the inner core through the side rail assembly.

In still another embodiment, a mattress assembly includes an inner core comprising a base core layer comprising planar top and bottom surfaces, and at least one additional layer comprising planar top and bottom surfaces disposed on the top surface of the base core layer, wherein the base core layer and/or the at least one additional layer further comprises a plurality of air channels extending across a width of the layer configured to permit the flow of fluid from and to the inner core.

The disclosure may be understood more readily by reference to the following detailed description of the various features of the disclosure and the examples included therein.

BRIEF DESCRIPTION OF THE DRAWINGS

Referring now to the figures wherein the like elements are numbered alike.

DETAILED DESCRIPTION

Disclosed herein are side rail assemblies (and mattress assemblies including the side rails), which provide user comfort with improved airflow to effectively dissipate user heat during use. Also disclosed are methods of improving the airflow throughout the mattress assemblies and dissipating user generated heat and moisture therein. In one embodiment, the side rail assemblies advantageously include air channels configured to permit the flow of air and moisture from inner layers of the mattress assembly through the side rail assembly and out to the surrounding environment. Such removal of warm air and moisture can improve the sleeping experience of the mattress user.

In another embodiment, air channels are formed in one or more layers of the mattress assembly to permit the flow of air and moisture from the one or more layers to the side rail assemblies. In certain embodiments, the air channels formed in the mattress assembly correspond to air channels formed in the side rail assemblies, thereby permitting a continuous air channel from the interior of the mattress to exterior. In other embodiments, the air channels formed in the mattress assembly extend in a downward angle through one or more layers of the mattress to a side rail assembly formed of a high airflow foam; the foam being configured to permit the passage of air and moisture there through to the environment.

Current mattress assemblies include one or more comfort layers disposed on top of a base core. Ventilation is often added down in the base core, such as through, for example, convolution. However, the more comfort layers in the design of the mattress assembly, the more barriers there are to movement of air between the layers. This prevents air flow and traps the heat and humidity near the sleep surface of the bed. As such, air channels can be formed through these comfort layers to permit the flow of air from all layers in the mattress assembly out through the channels. This allows the warm moist air to move away from the sleeper, allowing for a cooler and dryer sleep environment.

Figure 1:
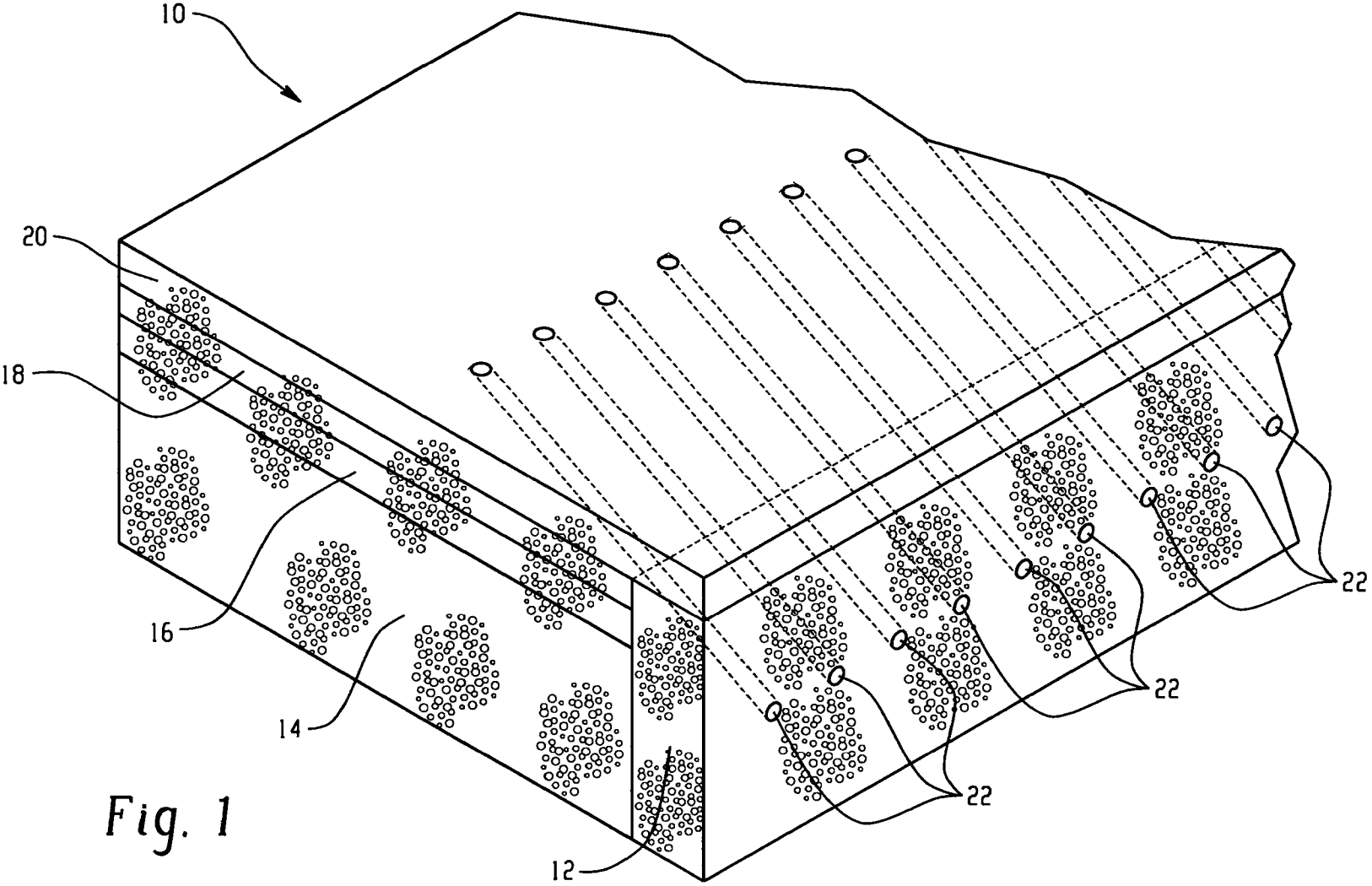
FIG. 1 illustrates a cross-sectional view of a mattress assembly in accordance with an embodiment of the present disclosure.

Turning now to FIG. 1, a cross-sectional view representative of the various mattress assemblies is illustrated, which are generally designated by reference numeral 10. As will be discussed herein, the various embodiments of the mattress assemblies disclosed herein have in common the following components: multiple stacked layers, and a side rail assembly 12 about at least a portion of the perimeter of the stacked mattress layers. The mattress assembly 10 includes a base core 14, with three stacked mattress layers disposed thereon—a support layer 16, a middle comfort layer 18, and a top comfort layer 20. The uppermost top comfort layer 20 has a planar top surface adapted to substantially face the user resting on the mattress assembly and having length and width dimensions sufficient to support a reclining body of the user. A plurality of air channels 22 extend through the four layers of the mattress assembly 10 from a central region of the mattress out through the side rail assembly.

In another embodiment, the plurality of air channels 22 may extend through less than all the layers of the mattress, such as, for example, from the top comfort layer down through the support layer and out through the side rail assembly 12. In still another embodiment, the plurality of air channels 22 may extend through one or more of the layers of the mattress assembly 10, but do not extend out through the side rail assembly 12. Rather, the side rail assembly may include a high air flow foam in the region where the plurality of air channels 22 meet the side rail assembly 12, such that the air flow from the channels is permitted to flow through the high airflow foam and exit to the environment.

As used herein, a high airflow foam is generally intended to be a foam having an open cell structure with a large cellular or a random cell structure, wherein movement of moisture and air through one or more of the side rails in the assembly can occur. The open cell foam structure includes a plurality of interconnected cells, wherein the percentage of intact windows (i.e., cell walls) between adjacent cells is less than about 50 percent; specifically less than about 40 percent; more specifically less than about 30 percent; and still more specifically less than about 20 percent. The large cell structure can also be defined by the number of cells per linear inch. In one embodiment, the large cell structure is about 10 to 40 cells per inch, with about 15 to 30 cells per inch in other embodiments, and with about 20 cells per inch in still other embodiments. The hardness of the high airflow foam, also referred to as the indention load deflection (ILD) or indention force deflection (IFD), is within a range of about 35 to about 100 pounds-force, wherein the hardness is measured in accordance with ASTM D-3574. In one embodiment, the hardness is about 40 to about 90 pounds-force; and specifically about 50 to about 75 pounds-force. The high air flow foam can further include a density of about 1.0 to about 3.0 pounds per cubic foot; and specifically about 1.2 to about 2.0 pounds per cubic foot.

The plurality of air channels 22 can have any size and shape configured to adequately permit the flow of air and moisture from the layers of the mattress and enable the dissipation of heat and moisture on the sleep surface of the mattress assembly. In the embodiment of FIG. 1, the plurality of air channels 22 have a downward orientation, beginning at the top comfort layer 20 in an interior/central region of the mattress and extending down through the three layers beneath while extending from the interior region out to the side rail assembly 12. In this embodiment, the plurality of air channels 22 extend through the side rail assembly 12, forming apertures therein in a vertical position of the side rail assembly adjacent to the base core 14. By angling the plurality of air channels 22 downwardly as described herein, ventilation is permitted to the mattress lower layers (e.g., support layer 16, base core 14) even if a user's bodyweight closes off the plurality of air channels 22 near the surface of the mattress (e.g., the top comfort layer 20).

Again, if a side rail assembly at least partially formed of high air flow foam is used, or part of the rail is designed to allow air flow through the rail, the plurality of air channels need not be cut through the side rails. Rather, the plurality of air channels can be cut into the mattress inner core before the rails are attached to the mattress inner core to form the mattress assembly. When the side rails are attached, the section(s) of the side rail that will be used to channel the air out of the bed, such as the high airflow foam portion, will be masked to prevent the application of adhesive in this area. Masking this area will prevent the adhesive from blocking the air flow through this region of the side rails.

Figure 2A:
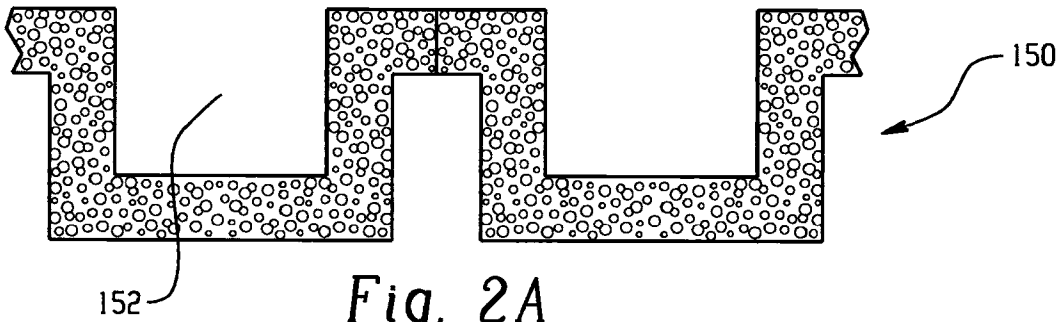
FIG. 2 illustrates a perspective view of a mattress layer for a mattress assembly in accordance with an embodiment of the present disclosure.
Figure 2B:
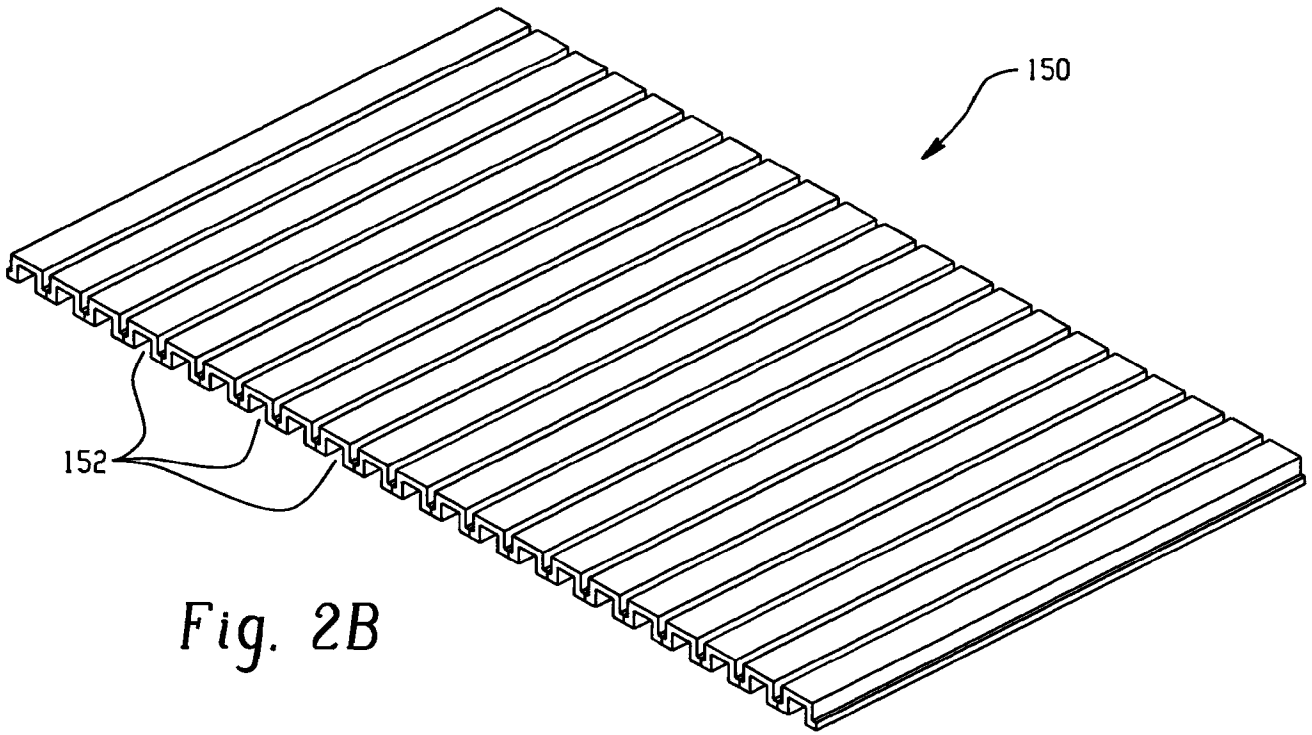

In another embodiment, an entire layer of the mattress assembly can form the plurality of air channels, rather than channels being diagonally cut through one or more layers. FIG. 2 illustrates an exemplary embodiment of a mattress layer 150 comprising a plurality of air channels 152. The plurality of air channels 52 extend across the full width of the layer 150 and permit air to flow out of the various layers in the mattress into the air channels and out through the sides of the mattress. In one embodiment, the mattress layer 150 can be used in a mattress assembly without side rail assemblies. In such an embodiment, the mattress layer 150 can be disposed, for example, as a base core layer in the mattress assembly. In another embodiment, the mattress layer 150 can be disposed in the mattress assembly as a base core layer or any intermediate/middle layer(s) below the comfort layers, wherein the mattress assembly further includes high airflow side assemblies. The mattress layer 150 can be positioned in the mattress such that the plurality of air channels 152 channel air out of the mattress to a high airflow section of the rail, as will be described in greater detail below. The mattress layer 150 can be formed of a polyethylene foam.

While discussion will continue with respect to the side rail assemblies and their use in mattresses having foam base cores, it is to be understood that the base core 14 of the mattress assemblies described herein can be any suitable base known to those having skill in the art. The base core layer 14 can be a standard spring support unit (e.g., a pocketed coil base or an innerspring assembly) or, alternatively, the layer can be formed of polyurethane foam, although other foams can be used, including without limitation, viscoelastic foams. In one embodiment, the base core foam layer is an open cell polyurethane foam. In other embodiments, the base core foam layer is closed cell polyurethane foam.

Figure 3:
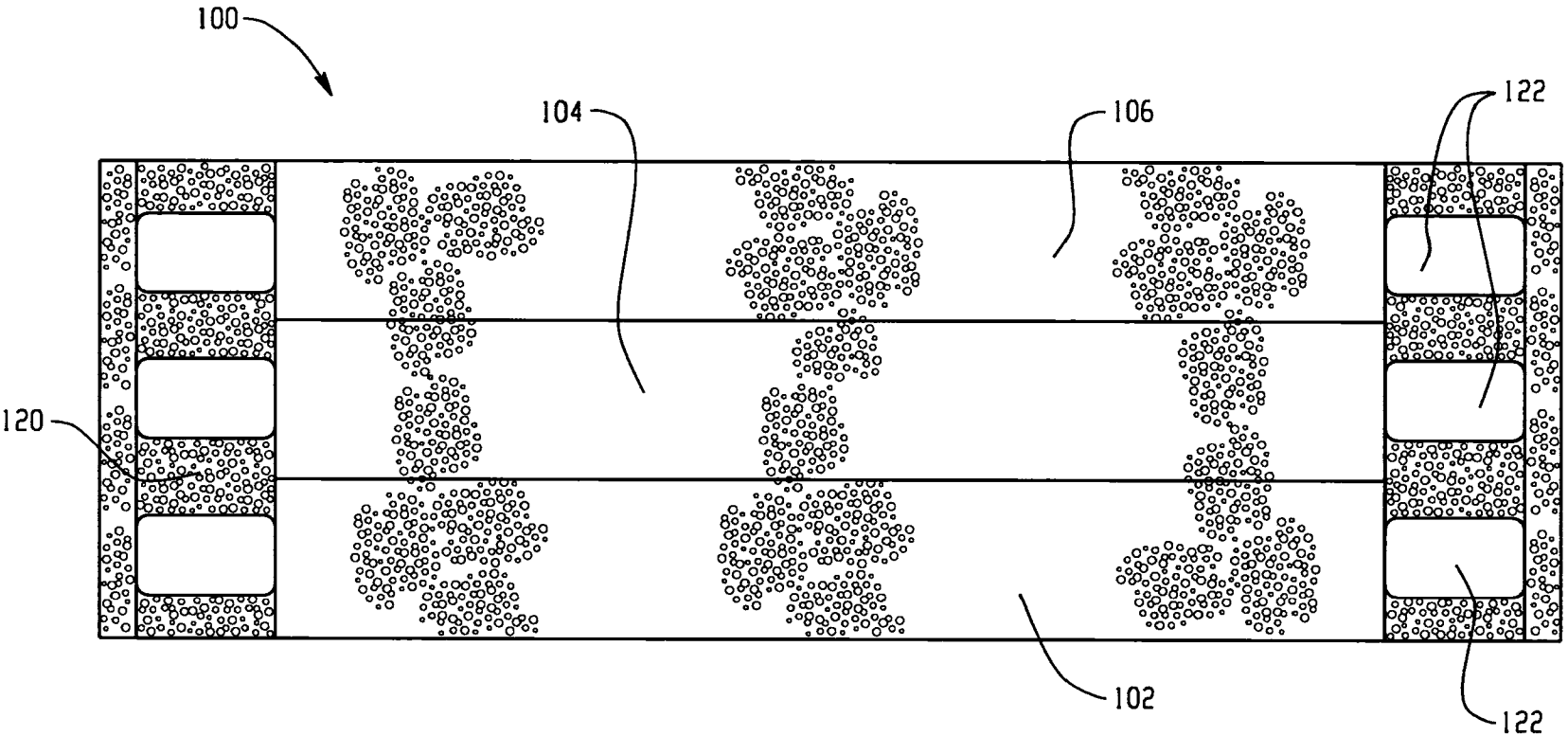
FIG. 3 illustrates a cross sectional view of a mattress assembly taken in accordance with another embodiment of the present disclosure.

The side rail assemblies can be disposed about a perimeter of the mattress inner core and provide support to the edge of a mattress. FIG. 3 shows a cross sectional view of a mattress assembly having a side rail assembly in accordance with one embodiment. The mattress assembly 100 includes a base core layer 102 configured with generally planar top and bottom surfaces. For this as well as the other embodiments disclosed herein, the base core layer 102 is chosen to have a thickness greater than or equal to the overall thickness of the mattress assembly. Generally, the thickness of the base core layer 102 is 4 inches to 10 inches, with about 6 inches to 8 inches thickness in other embodiments, and about 6.5 inches in still other embodiments. In one embodiment, the base core layer is an open cell polyurethane foam. In other embodiments, the base core layer is a closed cell polyurethane foam. In still other embodiments, the base core layer 102 includes a plurality of spring coils. As a foam, the base core layer 102 has a density of 1 pound per cubic foot (lb/ft$^3$) to 5 lb/ft$^3$. In other embodiments, the density is 1 lb/ft$^3$ to 3 lb/ft$^3$ and in still other embodiments, from 1 lb/ft$^3$ to 2 lb/ft$^3$. By way of example, the density can be 1.65 lb/ft$^3$. The hardness of the base core layer, also referred to as the indention load deflection (ILD) or indention force deflection (IFD), is within a range of 20 to 40 pounds-force, wherein the hardness is measured in accordance with ASTM D-3574 and is generally defined as the amount of force in pounds required to indent a 50" disc into a 15"×15"×4" foam sample and make a 1" indentation. In one embodiment, the hardness is about 32 to 35 pounds-force.

A relatively thin pre-stressed polyurethane foam layer 104 including planar top and bottom surfaces is disposed on the base core layer 102. Suitable pre-stressed polyurethane foams are generally formed in the manner disclosed in U.S. Pat. No. 7,690,096 to Gladney et al., incorporated herein by reference in its entirety. By way of example, a force can be applied to at least a section of a standard polyurethane foam layer in an amount sufficient to temporarily compress its height so as to permanently alter a mechanical property of the foam layer to provide a pre-stressed foam layer having a firmness that is different from the firmness of a similar polyurethane foam that was not pre-stressed. The pre-stressed polyurethane foam layer is a standard polyurethane foam as noted above (i.e., not viscoelastic) and generally has a pre-stressed thickness of less than 1 inch. The density is generally less than 2.5 lb/ft$^3$ in some embodiments, and less than 2 lb/ft$^3$ in still other embodiments. The hardness is generally less than 30 pounds-force in some embodiments, and less than pounds-force in still other embodiments. In one embodiment, the thickness is 0.5 inches, the hardness is 22 pounds-force, and the density is 1.5 lb/ft$^3$.

A cover panel 106 is formed of a viscoelastic foam and disposed on the polyurethane foam layer 104. The viscoelastic polyurethane foam has an open cell structure, wherein the percentage of intact windows (i.e., cell walls) between adjacent cells is less than 50 percent in one embodiment, and less than 40 percent in other embodiments, and less than 30 percent in still other embodiments. The cover panel 106 has planar top and bottom surfaces. The thickness of the cover panel is generally less than 3" in some embodiments, and less than 2" in other embodiments. The density of the cover panel layer 106 is less than 6 lb/ft$^3$ in some embodiments, and less than 2.5 lb/ft$^3$ in other embodiments. In one embodiment, the hardness is generally less than 15 pounds-force. In one embodiment, the cover panel is at a thickness of 1.5", a density of 2.5 lb/ft$^3$, and a hardness is 12 pounds-force.

The various multiple stacked mattress layers 102, 104, and 106 may be adjoined to one another using an adhesive or may be thermally bonded to one another or may be mechanically fastened to one another.

The mattress assembly further includes a foam side rail assembly 120 about all or a portion of the perimeter of the mattress layers 102, 104, 106. The side rails that define the assembly may be attached or placed adjacent to at least a portion of the perimeter of the mattress layers 102, 104, 106. Side rails may be placed on opposing sides of the stacked mattress layers, on all four sides of the stacked mattress layers, or only on one side of the stacked mattress layers. In certain embodiments, the side rails may comprise edge supports with a firmness greater than that provided by the stacked mattress layers. The side rails may be fastened to the stacked mattress layers via adhesives, thermal bonding, or mechanical fasteners.

The side rail assembly 120 is formed of a foam having a plurality of air channels 122 formed therein. In one embodiment, the foam is polyethylene foam. The plurality of air channels 122 can be formed by cutting out portions of the foam, or the foam side rail assembly 120 can be extruded with the plurality of air channels 122 formed therein. In this embodiment, the foam side rail assembly is a single layer of foam. In other embodiments, as will be discussed in more detail below, the foam side rail assembly can have multiple layers of the same or different foams. The plurality of air channels 122 create airflow pathways wherein movement of moisture and air from the mattress through one or more of the side rails in the assembly 120 can occur.

Figure 5:
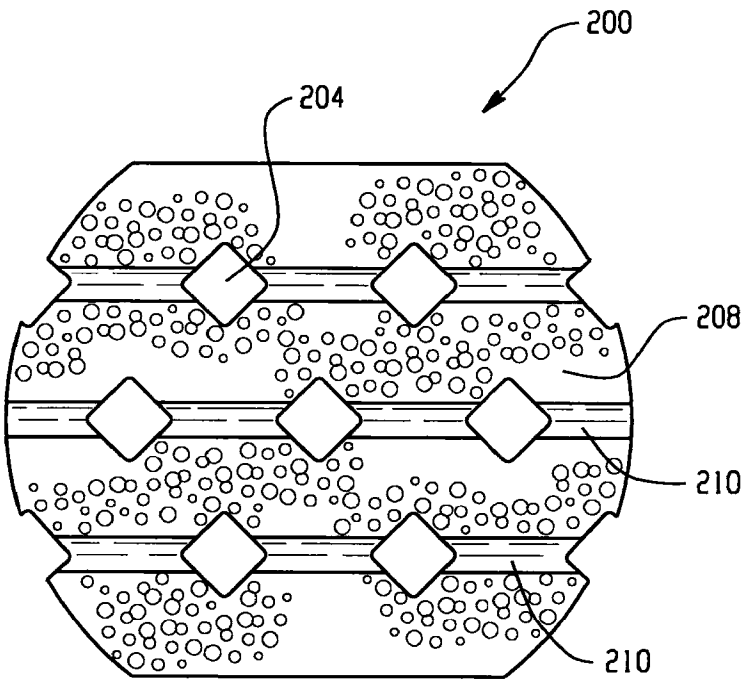
FIGS. 4 and 5 illustrate perspective views of a foam side rail assembly in accordance with an embodiment of the present disclosure.
Figure 4:
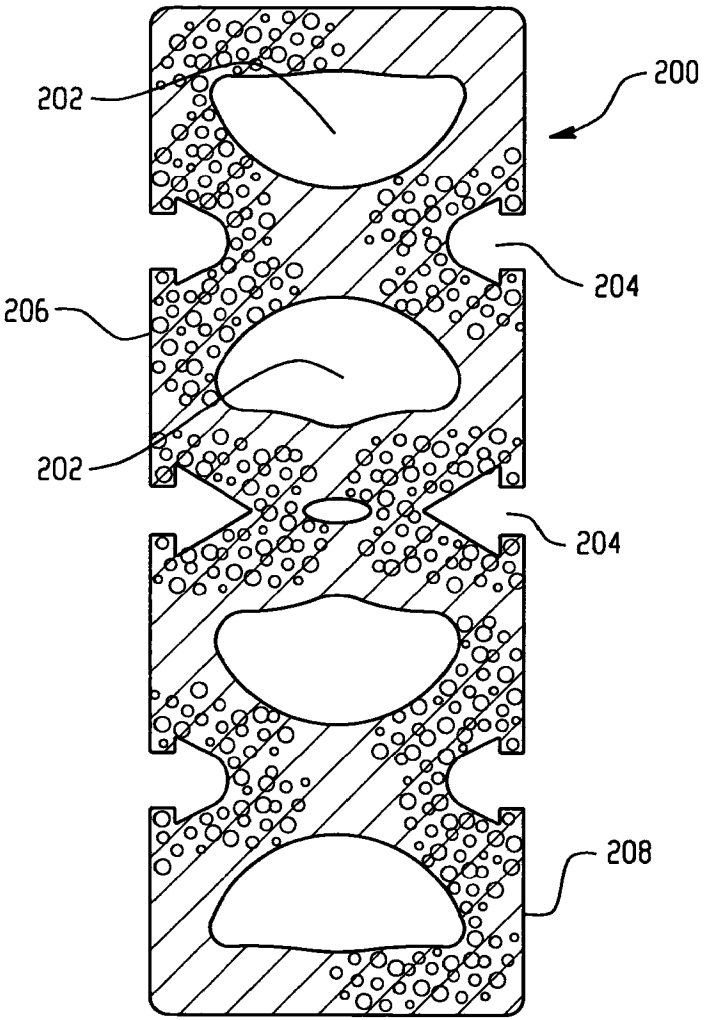

FIGS. 4 and 5 further illustrate two different perspective views of an exemplary embodiment of a foam side rail assembly 200. FIG. 4 is a cross-sectional end view of the foam side rail assembly 200 and illustrates a plurality of channels 202 that extend through the length of the foam side rail. The number of channels extending through the length of the foam side rail can depend on several factors, such as, for example, the height of the rail, the type of foam used, the desired firmness of the mattress assembly, and the like. The shape and number of the channels will depend on the desired properties and air flow rates of the mattress assembly and can be properly configured by one of skill in the art. In this embodiment, the foam side rail assembly 200 includes four distinct channels 202, extending the length of the side rail. The channels have a generally semi-circular shape to provide a desired level of structure and support to the foam side rail assembly 202.

The foam side rail assembly 200 further includes a plurality of orifices 204 disposed along the height of the rail on a side 206 of the rail in physical communication with the mattress and a side 208 of the rail opposite the mattress. In this embodiment, the plurality of orifices 204 are equidistantly spaced apart and are disposed in the foam side rail between each of the plurality of air channels. The plurality of orifices extend through the rail in a substantially perpendicular direction to the length of the rail and the plurality of air channels. Three orifices are disposed on either side of the rail and can extend there through to permit flow of air through the width of the side rail. In other embodiments, the foam side rail assembly can include more or less orifices and the number of orifices on each side of the rail can be the same or different. Like the plurality of air channels 202, the plurality of orifices 204 provide additional openings into the foam side rail and permit more airflow out of the side rail from the mattress. The plurality of orifices 204 can have any size and shape and will depend on the desired properties and air flow rates of the mattress assembly and can be properly configured by one of skill in the art.

FIG. 5 illustrates another perspective view of the foam side rail assembly 200, this time looking at the surface of the side 208, which would be the outward facing side of the rail, opposite the mattress inner core. As can be seen, the plurality of orifices 204 disposed in the side 208 are spaced equidistantly apart in both the vertical and horizontal direction. The plurality of orifices 204 can be vertically offset, as shown in FIG. 5, or they can be aligned vertically. In this embodiment, each of the plurality of orifices 204 has a generally square shape. In other embodiments, each orifice can have a different shape, such as circular, rectangular, polygonal, and the like. The side 208 further includes ridges 210 that extend through each line of orifices 204 on the surface of side 208. Ridges can also be formed on the opposite side 206, extending through each of the three lines of orifices on that side.

In certain embodiments, the foam side rail assembly 200 can include additional layer or layers disposed above and/or below the side rail. For example, the foam side rail assembly 200 could further include a bottom layer and a top layer (not shown). Each of the bottom layer and top layers could be hollow, or in other words, also have an air channel formed therein extending the length of the rail. The hollow bottom and top layers provide material savings, reduce weight, and allow additional airflow there through, while also providing support around the middle portion of the foam side rail assembly 200. The bottom and top layers can be formed of the same foam as the foam side rails assembly 200 or it can be different foam. Also, the bottom layer can be formed of the same foam as the top layer, or the foams can be different. In one embodiment, the bottom layer and top layers are formed of a reticulated polyurethane foam.

The foam side rail assemblies described herein can be used with a mattress inner core, as illustrated in FIG. 3. The foam side rail assemblies can also be used with a mattress inner core having a plurality of air channels disposed therein, such as the mattress inner core embodiment illustrated in FIG. 1. In such an embodiment, the plurality of air channels in the mattress inner core can be configured to generally align with the plurality of channels and/or the plurality of orifices formed in the foam side rail assemblies. Such a combination could provide additional airflow through the mattress, and thereby further improve the heat and moisture dissipation within the mattress assembly.

Figure 6:
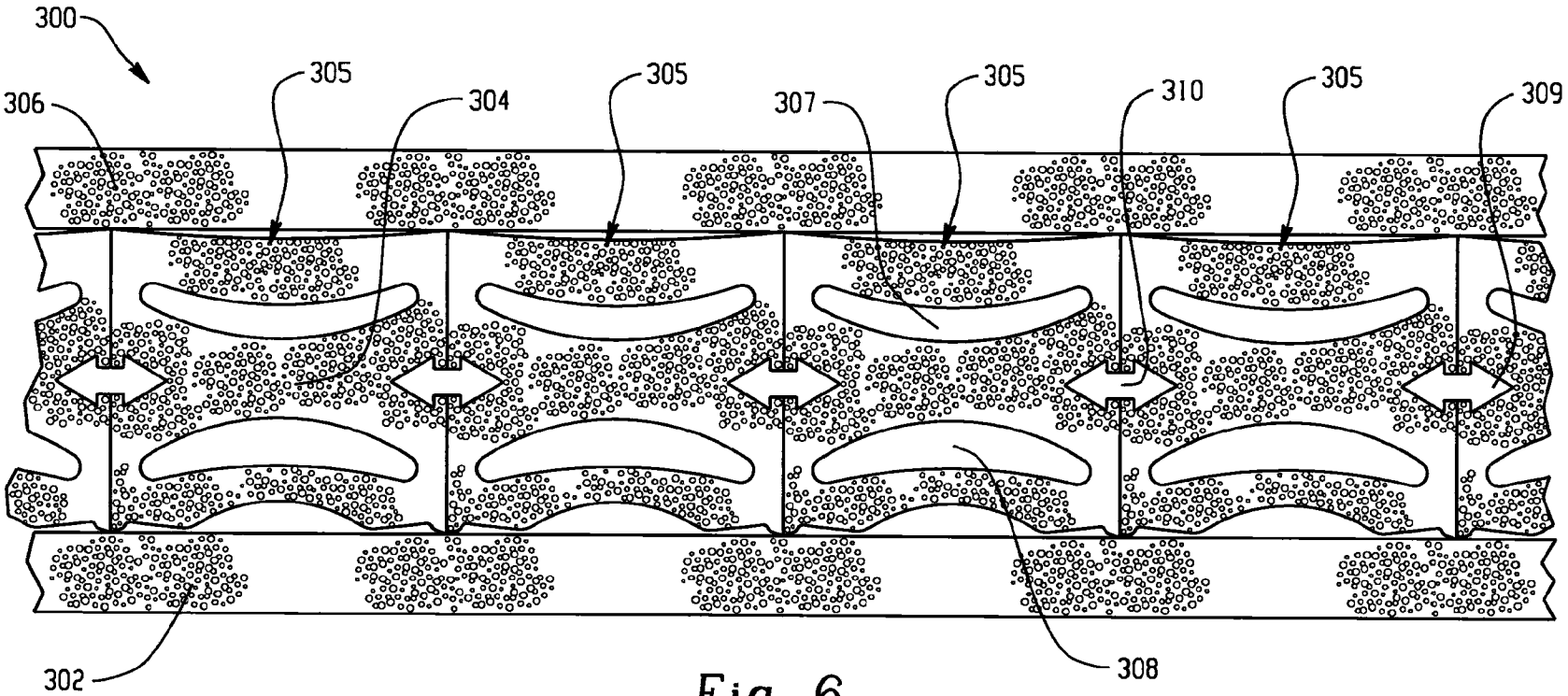
FIGS. 6 and 7 illustrate perspective views of a foam side rail assembly in accordance with another embodiment of the present disclosure.
Figure 7:
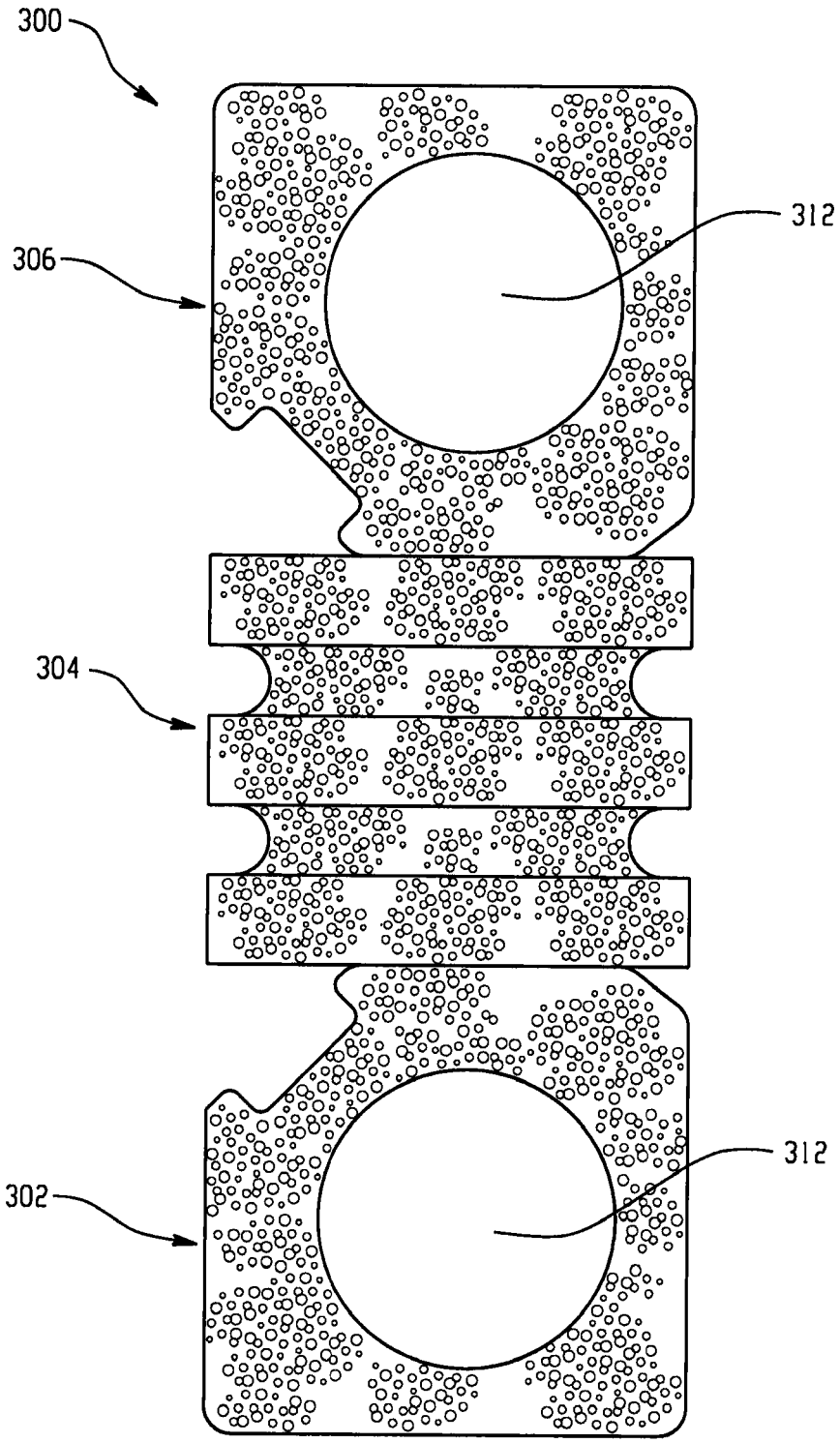

Turning now to FIGS. 6 and 7, another exemplary embodiment of a foam side rail assembly 300 is illustrated. FIG. 6 is a perspective view of the foam side rail assembly taken along the length of the rail. The foam side rail assembly 300 includes a bottom layer 302, a middle layer 304, and a top layer 306. Each of the three layers are formed of foam. In one embodiment, each layer is formed of a different foam. In another embodiment, the top and bottom layers are formed of one type of foam, while the middle layer is formed of another. In still another embodiment, all three layers are formed of the same foam.

The middle layer 304 is formed of repeated sections 305 of foam that are attached together, such as with an adhesive. Each section 305 includes an upper 307 and lower 308 air channel. The section 305 further includes an orifice 309 on each end of the section 305, such that when the sections are adhered together, another air channel 310 is formed therebetween. Each of the air channels are configured to allow air flow through the foam side rail assembly 300, so that air, heat, moisture, and the like, formed in a mattress inner core to which the assembly can be attached, is permitted to flow out through the middle layer 304. In one embodiment, the middle layer 304 is formed of a reticulated or large open cell structure polyurethane foam, such as the high airflow foam described herein. In another embodiment, the middle layer 304 is formed of a polyethylene foam.

The bottom layer 302 and the top layer 306 are disposed below and above the middle layer 304, respectively. The bottom and top layer can have the same thickness or they can have different thicknesses, depending on the height of the mattress inner core and the desired position of the middle layer 304 with respect to the mattress inner core. In this embodiment, each of the bottom layer 302 and the top layer 306 are hollow, as illustrated in the FIG. 7 by the channels 312 extending through both layers. The hollow bottom and top layers provide material savings, reduce weight, and allow additional airflow therethrough, while also providing support around the middle layer 304 of the foam side rail assembly 300. In one embodiment, the bottom layer 302 is formed of a polyethylene foam and the top layer 306 is formed of a polyurethane foam. In another embodiment, both the bottom layer 302 and the top layer 306 are formed of a reticulated polyurethane foam.

In an exemplary embodiment, the top layer 306 and the bottom layer 302 are adhered to the mattress inner core. The middle layer 304 is advantageously free from the adhesive, thereby ensuring the adhesive does not adversely affect the air flow through the side rail, specifically through the middle layer. As used herein, the term adhesive generally means the side rail assemblies may be fastened to the stacked mattress layers via adhesives, thermal bonding, or mechanical fasteners. Again, if the rails are adhesively or thermally attached to the mattress layers, it is desirable that the portions of the foam side rail assembly having the plurality of channels and/or plurality of orifices are free from the adhesive or thermal attachment points such that air and moisture transfer is uninterrupted by the thermal bonding process or adhesive and airflow from the mattress layers through the side rails to the environment is maintained.

For ease in manufacturing the mattress assembly, the foam side rail assembly may be assembled in linear sections that are joined to one another to form the perimeter about the mattress layers. An optional fabric layer (not shown) can be disposed about the perimeter of the side rail, i.e., serves as a mattress border. The fabric border layer is attached at one end to the top planar surface of the uppermost mattress layer and at the other end to the bottom planar surface of the bottom most layer. In one embodiment, at least a portion of the fabric layer is formed of a spacer fabric to provide a further increase in airflow. As used herein, spacer fabrics are generally defined as pile fabrics that have not been cut including at least two layers of fabric knitted independently that are interconnected by a separate spacer yarn. The spacer fabrics generally provide increased breathability relative to other fabrics, crush resistance, and a three dimensional appearance. The at least two fabric layers may be the same or different, i.e., the same or different density, mesh, materials, and like depending on the intended application. When employing the spacer fabric, a lightweight flame retardant barrier layer may be disposed intermediate to the mattress foam layers and the spacer fabric about the perimeter of the side rail assembly.

The mattress assemblies described herein may further include additional layers and the embodiments described herein are not intended to be limited with respect to number, type, or arrangement of layers in the mattress and side rail assembly. For example, an embodiment of a mattress assembly can further include a gel infused viscoelastic foam layer disposed within the mattress, such as on the support layer. In another embodiment, the mattress assembly further includes a cover panel formed of a viscoelastic foam disposed, for example, on the top layer of the mattress having a planar top surface and a convoluted bottom surface. The convoluted bottom surface, such as an egg crate structure, is in contact with the top planar surface of the mattress, which may be in one embodiment, the gel infused viscoelastic layer.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress assembly, comprising:

an inner core comprising a base core layer comprising planar top and bottom surfaces, and at least one additional layer comprising planar top and bottom surfaces disposed on the top surface of the base core layer;

a side rail assembly disposed about a perimeter of the inner core; and a plurality of air channels extending from a central region of the inner core to the side rail assembly configured to permit the flow of fluid from and to the inner core.

2. The mattress assembly of claim 1, wherein the plurality of air channels extend in a generally downward angle from the at least one additional layer into the base core layer.

3. The mattress assembly of claim 2, wherein the plurality of air channels further extend from the base core layer through the side rail assembly.

4. The mattress assembly of claim 1, wherein the plurality of air channels extend from the at least one additional layer through the side rail assembly.

5. The mattress assembly of claim 1, wherein the side rail assembly comprises a polyurethane foam comprising an open cellular structure, wherein the open cellular structure comprises about 10 to about 40 cells per inch, a hardness of about 35 pounds-force to about 100 pounds-force, and a density of about 1.2 pounds per cubic foot to about 2.0 pounds per cubic foot.

6. A side rail assembly for supporting an edge of a mattress, comprising multiple layers of stackedly arranged foam comprising at least one channel and/or a plurality of orifices, wherein the multiple layers are configured to be disposed about a perimeter of an inner core of the mattress, wherein the at least one channel extends through a length of the layer and the plurality of orifices extend through a width of at least one of the multiple layers, and wherein the at least one channel and/or the plurality of orifices are configured to permit the flow of fluid from and to the inner core through at least one of the multiple layers.

7. The side rail assembly of claim 6, wherein the foam is a reticulated polyurethane foam.

8. The side rail assembly of claim 6, wherein the foam is a polyethylene foam.

9. The side rail assembly of claim 6, wherein the multiple layer of foam comprise a bottom layer disposed beneath a first layer, wherein the bottom layer comprises a second foam having a channel extending through a length of the bottom layer.

10. The side rail assembly of claim 9, wherein the multiple layer of foam comprise a top layer disposed above the first layer, wherein the top layer comprises a third foam having a channel extending through a length of the top layer.

11. The side rail assembly of claim 10, wherein the second foam and the third foam are different.

12. The side rail assembly of claim 10, wherein the second foam and the third foam are the same, and the second foam and the third foam are different than the foam of the first layer.

13. The side rail assembly of claim 10, further comprising an adhesive disposed between the top layer and the inner core and the bottom layer and the inner core.

14. The side rail assembly of claim 6, wherein the first layer is comprised of a plurality of sections connected together to form the first layer, wherein each of the plurality of sections comprises the plurality of orifices.

15. The side rail assembly of claim 6, wherein each of the plurality of orifices are horizontally aligned and vertically offset.

16. A mattress assembly, comprising:

an inner core comprising a base core layer comprising planar top and bottom surfaces, and at least one additional layer comprising planar top and bottom surfaces disposed on the top surface of the base core layer;

a side rail assembly disposed about a perimeter of the inner core, wherein the side rail assembly comprises a layer of a foam comprising at least one channel and/or a plurality of orifices configured to permit the flow of fluid from and to the inner core through the layer; and a plurality of inner core air channels extending from a central region of the inner core to the at least one channel and/or plurality of orifices of the side rail assembly, wherein the plurality of inner core air channels are configured to permit the flow of fluid from and to the inner core through the side rail assembly.

17. The mattress assembly of claim 16, wherein the foam is a reticulated polyurethane foam.

18. The mattress assembly of claim 16, wherein the foam is a polyethylene foam.

19. The mattress assembly of claim 16, further comprising a bottom layer disposed beneath the layer, wherein the bottom layer comprises a second foam having a channel extending through a length of the bottom layer.

20. The side rail assembly of claim 19, further comprising a top layer disposed above the layer, wherein the top layer comprises a third foam having channel extending through a length of the top layer.

21. A mattress assembly, comprising:

an inner core comprising a base core layer comprising planar top and bottom surfaces, and at least one additional layer comprising planar top and bottom surfaces disposed on the top surface of the base core layer, wherein the base core layer and/or the at least one additional layer further comprises a plurality of air channels extending across a width of the layer configured to permit the flow of fluid from and to the inner core.

22. The mattress assembly of claim 21, wherein the base core layer comprises a polyethylene foam.

23. The mattress assembly of claim 21, wherein the at least one additional layer comprises a polyethylene foam.

24. The mattress assembly of claim 21, further comprising a side rail assembly disposed about a perimeter of the inner core.

25. The mattress assembly of claim 24, wherein the side rail assembly comprises a polyurethane foam comprising an open cellular structure, wherein the open cellular structure comprises about 10 to about 40 cells per inch, a hardness of about 35 pounds-force to about 100 pounds-force, and a density of about 1.2 pounds per cubic foot to about 2.0 pounds per cubic foot.

26. The mattress assembly of claim 25, wherein the plurality of air channels are in fluid communication with the polyurethane foam of the side rail assembly.

27. The mattress assembly of claim 25, wherein the side rail assembly comprises a layer of foam comprising at least one channel and/or a plurality of orifices, wherein the at least one channel extends through a length of the layer and the plurality of orifices extend through a width of the layer, and wherein the at least one channel and/or the plurality of orifices are configured to permit the flow of fluid from and to the inner core through the layer.

28. The mattress assembly of claim 27, wherein the plurality of air channels are in fluid communication with the foam layer of the side rail assembly.

* * * * *